US011041387B2

(12) United States Patent
Watanabe et al.

(10) Patent No.: US 11,041,387 B2
(45) Date of Patent: Jun. 22, 2021

(54) SCROLL FLUID MACHINE HAVING INJECTION HOLES THROUGH WHICH LUBRICANT IS INJECTED TO THE ORBITING BEARING

(71) Applicant: Hitachi Industrial Equipment Systems Co., Ltd., Tokyo (JP)

(72) Inventors: Sho Watanabe, Tokyo (JP); Yoshio Kobayashi, Tokyo (JP); Yoshiyuki Kanemoto, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 239 days.

(21) Appl. No.: 15/761,981

(22) PCT Filed: May 10, 2016

(86) PCT No.: PCT/JP2016/063863

§ 371 (c)(1),
(2) Date: Jul. 19, 2018

(87) PCT Pub. No.: WO2017/195272

PCT Pub. Date: Nov. 16, 2017

(65) Prior Publication Data

US 2018/0355722 A1 Dec. 13, 2018

(51) Int. Cl.
*F03C 2/00* (2006.01)
*F03C 4/00* (2006.01)
(Continued)

(52) U.S. Cl.
CPC ..... *F01C 21/04* (2013.01); *F01C 1/0215* (2013.01); *F04C 18/02* (2013.01);
(Continued)

(58) Field of Classification Search
CPC .... F04C 18/02; F04C 18/0215; F04C 23/008; F04C 29/0007; F04C 29/0014;
(Continued)

(56) References Cited

U.S. PATENT DOCUMENTS 8,764,423 B2 * 7/2014 Ignatiev ..... F04C 18/0215 418/55.5
2005/0220649 A1 * 10/2005 Sato ..... F01C 1/0215 418/55.3

(Continued)

FOREIGN PATENT DOCUMENTS

CN 102971535 A 3/2013
CN 103089620 A 5/2013

(Continued)

OTHER PUBLICATIONS

Chinese-language Office Action issued in Chinese Application No. 201680054797.0 dated Jan. 16, 2020 with partial English translation (10 pages).

(Continued)

*Primary Examiner* — Theresa Trieu
(74) *Attorney, Agent, or Firm* — Crowell & Moring LLP

(57) ABSTRACT

The purpose of the present invention is to provide a scroll fluid machine configured so that, during maintenance, grease can be easily supplied to a bearing regardless of an installation environment, thereby improving work efficiency. The present invention provides a scroll fluid machine characterized by comprising: a stationary scroll obtained by forming a wrap section on an end plate; an orbiting scroll obtained by forming a wrap section on an end plate such that the wrap section faces the wrap section of the stationary scroll; a drive shaft for driving the orbiting scroll; an orbiting bearing for supporting the drive shaft relative to the orbiting scroll; and a plurality of pouring openings for pouring a lubricant into the orbiting bearing from the outside.

19 Claims, 7 Drawing Sheets

(51) Int. Cl.

| | |
|---|---|
| ***F04C 15/00*** | (2006.01) |
| ***F04C 2/00*** | (2006.01) |
| ***F01C 21/04*** | (2006.01) |
| ***F04C 29/02*** | (2006.01) |
| ***F04C 18/02*** | (2006.01) |
| ***F01C 1/02*** | (2006.01) |
| *F04C 23/00* | (2006.01) |

(52) U.S. Cl.
CPC ..... *F04C 18/0215* (2013.01); *F04C 29/02* (2013.01); *F04C 23/008* (2013.01); *F04C 2240/30* (2013.01); *F04C 2240/50* (2013.01)

(58) Field of Classification Search
CPC ..... F04C 29/02; F04C 29/04; F04C 29/042; F04C 29/12; F04C 2240/30; F04C 2240/50; F01C 1/0215; F01C 21/04
USPC ..... 418/55.1–55.6, 57, 101; 417/310; 184/6.16–6.18
See application file for complete search history.

(56) References Cited

U.S. PATENT DOCUMENTS

2006/0266076 A1* 11/2006 Lifson ..... F04C 18/0292 62/513
2013/0149179 A1* 6/2013 Sato ..... F01C 1/0215 418/55.3
2016/0186754 A1* 6/2016 Cho ..... F04C 29/023 418/55.1
2018/0216461 A1* 8/2018 Watanabe ..... F04C 29/02 418/55.6

FOREIGN PATENT DOCUMENTS

| | | | | | |
|---|---|---|---|---|---|
| CN | 106574619 | A | | 4/2017 | |
| JP | 58-160583 | A | | 9/1983 | |
| JP | 7-2961 | Y2 | | 1/1995 | |
| JP | 9-53579 | A | | 2/1997 | |
| JP | 2002227779 | A | * | 8/2002 | ..... F04C 18/0215 |
| JP | 2005-282496 | A | | 10/2005 | |
| JP | 2015-113787 | A | | 6/2015 | |
| WO | WO 2012/043099 | A1 | | 4/2012 | |
| WO | WO 2016/080253 | A1 | | 5/2016 | |

OTHER PUBLICATIONS

International Search Report (PCT/ISA/210) issued in PCT Application No. PCT/JP2016/063863 dated Aug. 30, 2016 with English-language translation (five (5) pages).
Japanese-language Written Opinion (PCT/ISA/237) issued in PCT Application No. PCT/JP2016/063863 dated Aug. 30, 2016 (seven (7) pages).
Chinese-language Office Action issued in counterpart Chinese Application No. 201680054797.0 dated Jan. 29, 2019 (six (6) pages).
Extended European Search Report issued in counterpart European Application No. 16901621.9 dated Oct. 1, 2019 (eight (8) pages).
Hindi-language Office Action issued in Indian Application No. 201817027612 dated Oct. 9, 2020 with English translation (10 pages).

* cited by examiner

SCROLL FLUID MACHINE HAVING INJECTION HOLES THROUGH WHICH LUBRICANT IS INJECTED TO THE ORBITING BEARING

TECHNICAL FIELD

The present invention relates to a scroll fluid machine.

BACKGROUND ART

There is disclosed patent literature 1 as a related art of this technical field.

Patent literature 1 discloses a scroll fluid machine in which an oil supply hole is disposed on a front side of an eccentric shaft integrated with a drive shaft and is provided in an orbiting scroll to pass through in an axial direction of the orbiting scroll. The scroll fluid machine supplies grease toward a bearing of the eccentric shaft from an opening end on a front side of the oil supply hole (that is, on a side near a turning wrap). On a front side of a rotation preventing machine, the oil supply hole is provided in the orbiting scroll to pass through in the axial direction of the orbiting scroll. The grease is supplied toward the bearing of the rotation preventing machine from the opening end on the front side of the oil supply hole (that is, on a side near the turning wrap).

CITATION LIST

Patent Literature

Patent Literature 1: JP-A-2005-282496

SUMMARY OF INVENTION

Technical Problem

The scroll fluid machine disclosed in patent literature 1 is configured such that an orbiting bearing and a housing of the rotation preventing machine each are provided with only one oil supply hole for example, and the oil only can be supplied from one direction. Therefore, there is necessarily required a work space on the front side of the scroll fluid machine to replenish the grease. Further, in a case where there is an obstacle, the scroll fluid machine is necessarily moved, and thus the number of man-hours is significantly increased.

The invention has been made in view of the problems, and an object thereof is to provide a scroll fluid machine which can simply supply the grease to the bearing regardless of installation environments during maintenance, and workability is improved.

Solution To Problem

In order to solve the problem described above, according to the present invention, there is provided a scroll fluid machine, including: a stationary scroll which is provided with a wrap in an end plate; an orbiting scroll which is provided with a wrap facing the wrap of the stationary scroll in an end plate; a drive shaft which drives the orbiting scroll; an orbiting bearing which supports the drive shaft with respect to the orbiting scroll; and a plurality of injection holes through which a lubricant is injected to the orbiting bearing from an outer portion.

In addition, according to another aspect of the invention, there is provided a scroll fluid machine which includes a stationary scroll, an orbiting scroll which is provided to face the stationary scroll, a casing which is provided on an outer side in a radial direction of the orbiting scroll, a drive shaft which drives the orbiting scroll, and a plurality of rotation preventing machines which prevent the orbiting scroll from rotating. A bearing housing storing the plurality of rotation preventing machines is provided on a side near the casing and the orbiting scroll. At least one of the plurality of rotation preventing machines is provided with a plurality of injection holes on a side near the casing and on a side near the orbiting scroll to inject a lubricant from the outer portion to the bearing housing.

Advantageous Effects Of Invention

According to the invention, it is possible to provide a scroll fluid machine which is made to improve workability during maintenance.

DESCRIPTION OF EMBODIMENTS

First Embodiment

Figure 1:
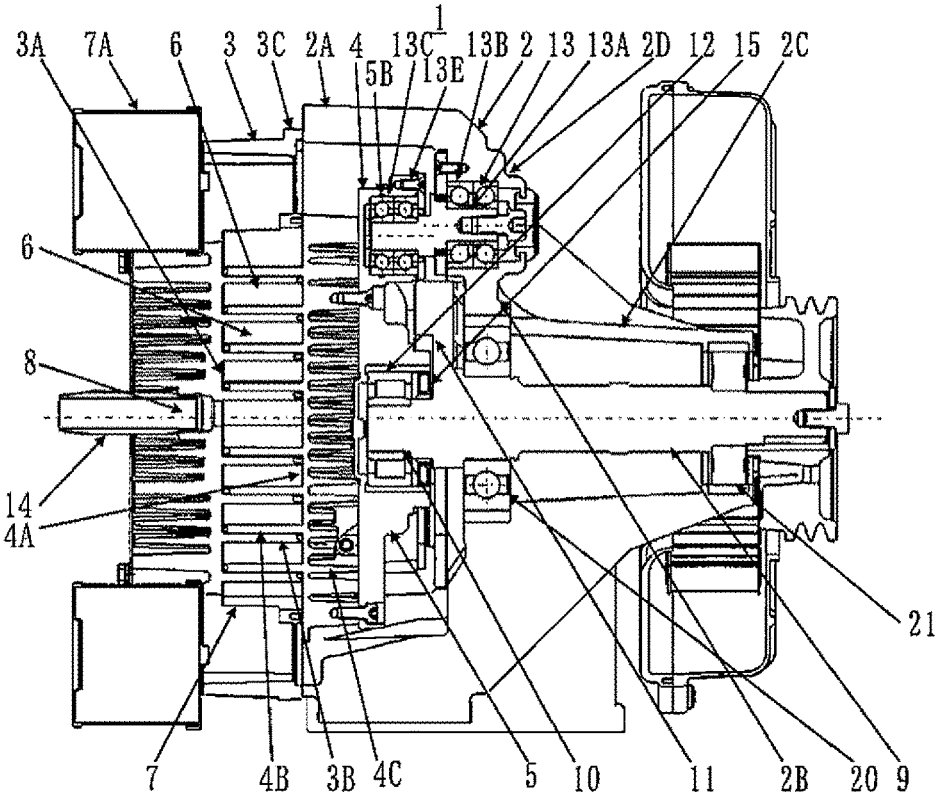
FIG. 1 shows a cross-sectional view of a scroll compressor according to a first embodiment of the invention.

As an example of a scroll fluid machine according to the invention, a scroll compressor according to a first embodiment will be described with reference to FIGS. 1 to 5.

The entire configuration of the scroll fluid machine according to this embodiment will be described using FIG. 1. A compressor body 1 employs a scroll air compressor, and includes a casing 2, a stationary scroll 3, an orbiting scroll 4, a drive shaft 9, a crank 10, and a rotation preventing machine 13 which will be described below.

The casing 2 forming an outer shell of the compressor body 1 is formed as a bottomed cylindrical body of which one side in an axial direction is closed and the other side in the axial direction is opened as illustrated in FIG. 1. In other words, the casing 2 is mainly configured by a cylindrical portion 2A of which the other side (near the stationary scroll 3 described below) in the axial direction is opened, an annular bottom 2B which is integrally formed in one side in the axial direction of the cylindrical portion 2A and extends inward in a radial direction, and a cylindrical bearing mounting portion 2C which protrudes toward both sides in the axial direction from an inner circumference side of the bottom 2B.

In addition, the orbiting scroll 4, the crank 10, and the rotation preventing machine 13 described below are stored in the cylindrical portion 2A of the casing 2. In addition, on a side near the bottom 2B of the casing 2, a plurality of the rotation preventing machines 13 (only one is illustrated in FIG. 1) are provided in a gap with an end plate 4A of the orbiting scroll 4 to be disposed later at a predetermined interval therebetween in a circumferential direction.

The stationary scroll 3 is a scroll member which is provided to be fixed to the end side of the opening of the casing 2 (the cylindrical portion 2A). Then, as illustrated in FIG. 1, the stationary scroll 3 is mainly configured by an end plate 3A which is formed in a disk shape, a spiral wrap 3B which is erected in the surface of the end plate 3A, and a cylindrical support portion 3C which is provided on an outer circumferential side of the end plate 3A to surround the wrap 3B from the outer side in the radial direction and fixed to the end side of the opening of the casing 2 (the cylindrical portion 2A) using a plurality of bolts (not illustrated).

The orbiting scroll 4 of the other scroll member is provided facing the stationary scroll 3 in the axial direction so as to be turned in the casing 2. Then, as illustrated in FIG. 1, the orbiting scroll 4 is mainly configured by the end plate 4A of a disk shape, a wrap 4B which is erected in the surface of the end plate 4A, a plurality of cooling fins 4C which are erected on the opposite side to the wrap 4B, and a boss plate portion 5 which protrudes to a rear surface (a surface on the opposite side to the wrap 4B) of the end plate 4A and is mounted in the crank 10 described later through an orbiting bearing 12.

In addition, on the outer side in the radial direction of the boss plate portion 5, the rotation preventing machines 13 described later are disposed with a predetermined interval therebetween in the circumferential direction of the orbiting scroll 4 in a gap with the bottom 2B of the casing 2. Then, the boss plate portion 5 of the orbiting scroll 4 is disposed such that the center thereof is decentered in the radial direction by a predetermined dimension (turning radius) with respect to the center of the stationary scroll 3.

A plurality of compressors 6 are defined between the wrap 3B of the stationary scroll 3 and the wrap 4B of the orbiting scroll 4. Each compressor 6 is formed such that the wrap 3B of the stationary scroll 3 is disposed to be overlapped with the wrap 4B of the orbiting scroll 4 as illustrated in FIG. 1 and each compressor 6 is interposed by the end plates 3A and 4A between these wraps 3B and 4B.

An intake port 7 is provided on an outer circumferential side of the stationary scroll 3. The intake port 7 absorbs the air from the outer portion through an air filter 7A for example. The air is continuously compressed along the turning operation of the orbiting scroll 4 in each compressor 6.

A discharge port 8 is provided in the center of the stationary scroll 3. The discharge port 8 is used to discharge the compressed air from the compressor 6 on the innermost side in the radial direction among the plurality of compressors 6 toward a storage tank described later (not illustrated). In other words, the orbiting scroll 4 is driven by an electric motor (not illustrated) or the like through the drive shaft 9 and the crank 10. The orbiting scroll turns about the stationary scroll 3 in a state of being restricted in rotation by the rotation preventing machine 13 described later.

With this configuration, the compressor 6 on the outer side in the radial direction among the plurality of compressors 6 absorbs the air from the intake port 7 of the stationary scroll 3. The air is continuously compressed in each of the compressors 6. Then, the compressor 6 on the inner side in the radial direction is used to discharge the compressed air from the discharge port 8 located at the center of the end plate 3A to the outer portion.

The drive shaft 9 is provided to be turned through a load side bearing 20 disposed in the bearing mounting portion 2C of the casing 2 near the compressor body 1 and an anti-load side bearing 21 disposed away from the compressor body 1. The drive shaft 9 is disposed such that the base end side (a side in the axial direction) thereof protruding to the outer portion of the casing 2 is detachably connected to a drive source of the electric motor (not illustrated) or the like, and is provided to be rotatably driven by the electric motor. In addition, a bearing housing 5A in the boss plate portion 5 of the orbiting scroll 4 is connected to the tip end side (the other side in the axial direction) of the drive shaft 9 to be turned through the crank 10 and the orbiting bearing 12, described later.

The crank 10 decentered to the center of the drive shaft 9 is integrally provided on the tip end side of the drive shaft 9. The crank 10 is connected to the bearing housing 5A of the boss plate portion 5 of the orbiting scroll 4 through the orbiting bearing 12 described later. Then, the crank 10 is rotated integrally to the drive shaft 9. The rotation at that time is converted to a turning operation of the orbiting scroll 4 through the orbiting bearing 12.

The plurality of rotation preventing machines 13 is provided between the bottom 2B of the casing 2 and a rear surface side of the orbiting scroll 4 (only one is illustrated in FIG. 1). For example, the rotation preventing machines 13 is configured by an auxiliary crank shaft 13A, and auxiliary crank bearings 13B and 13C which are respectively disposed on sides near the casing 2 and the orbiting scroll 4. Then, the auxiliary crank bearings 13B and 13C are stored in bearing housings 2D and 5B which are provided in the casing 2 and the boss plate portion 5 of the orbiting scroll 4 respectively.

Then, the rotation preventing machine 13 is used to prevent the rotation of the orbiting scroll 4 and to receive a thrust load from the orbiting scroll 4 by the bottom 2B of the casing 2. Further, for example, a ball coupling mechanism or an Oldham's shaft coupling mechanism may be used as the rotation preventing machine 13 instead of an auxiliary crank mechanism.

A discharge pipe 14 is provided to be connected to the discharge port 8 of the stationary scroll 3. The discharge pipe 14 forms a discharge fluid path which communicates between the storage tank (not illustrated) and the discharge port 8.

In the drive shaft 9, a balance weight 11 is provided to stabilize the turning operation of the orbiting scroll 4. In a case where the compressor is operated, the balance weight 11 rotates integrally to the drive shaft 9.

The orbiting bearing 12 is disposed between the bearing housing 5A of the boss plate portion 5 of the orbiting scroll 4 and the crank 10. The orbiting bearing 12 supports the crank 10 with respect to the bearing housing 5A of the boss plate portion 5 of the orbiting scroll 4. The orbiting bearing 12 is used to compensate the turning operation of the orbiting scroll 4 in a predetermined radius with respect to an axial line of the drive shaft 9.

Figure 2:
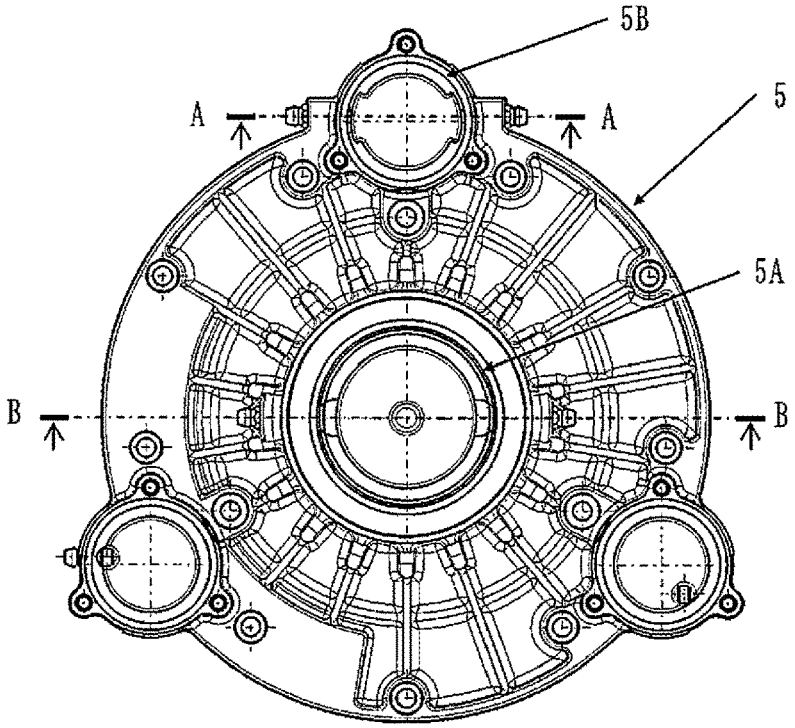
FIG. 2 shows a front view of a boss plate portion according to the first embodiment of the invention.
Figure 3:
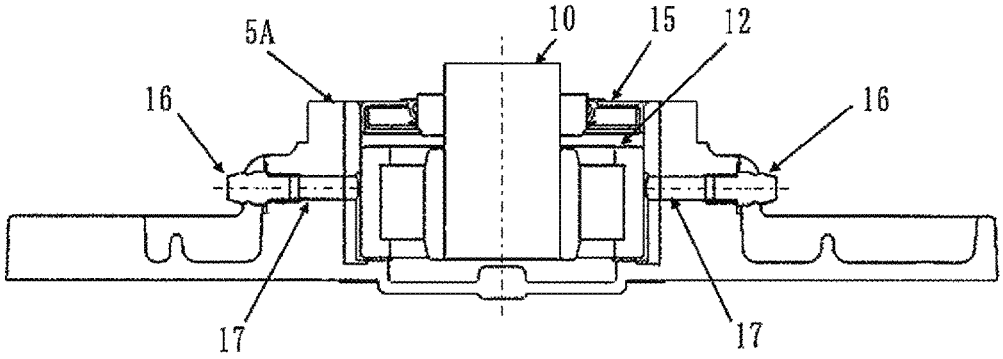
FIG. 3 shows a cross-sectional view of the boss plate portion according to the first embodiment of the invention.
Figure 4:
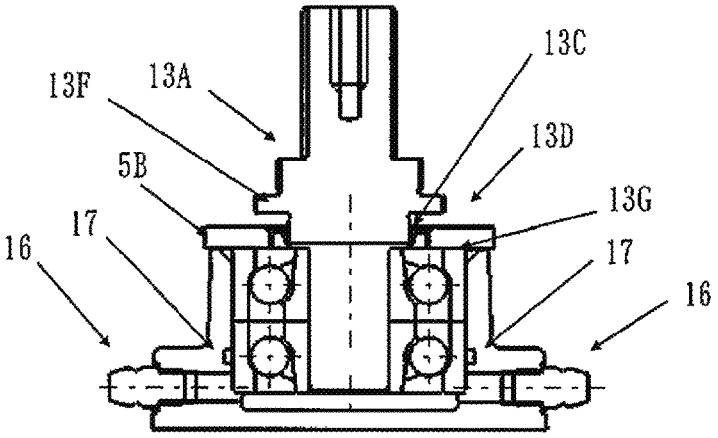
FIG. 4 shows a cross-sectional view of the boss plate portion according to the first embodiment of the invention.

FIG. 2 illustrates the boss plate portion 5 according to this embodiment. FIGS. 3 and 4 illustrate cross-sectional views taken along lines A-A and B-B of the bearing housings 5A and 5B of the boss plate portion 5.

The orbiting bearing 12 is surrounded by the bearing housing 5A of the boss plate portion 5, a seal member 15, and the crank 10 of the drive shaft 9. The seal member 15 is provided between the bearing housing 5A of the boss plate portion 5 to seal a lubricant of the orbiting bearing 12 and the crank 10 of the drive shaft 9.

The auxiliary crank bearing 13C is surrounded by the bearing housing 5B of the boss plate portion 5, a pressing plate 13D, a seal member 13F, and the auxiliary crank shaft 13A. The auxiliary crank bearing 13C is inserted to the bearing housing 5B of the boss plate portion 5, and is strongly fastened by a flathead bolt 13E (illustrated in FIG. 1) together with the pressing plate 13D. The depth of the bearing housing 5B is set to be smaller than the height of the auxiliary crank bearing 13B. The pressing plate 13D is fastened by the flathead bolt 13E so as to pre-load an outer wheel 13G of the auxiliary crank bearing 13C. The seal member 13F is provided between the pressing plate 13D and the auxiliary crank shaft 13A in order to seal the lubricant of the auxiliary crank bearing 13C.

In this embodiment, as pipes to supply the lubricant from the outside to the orbiting bearing 12 and the rotation preventing machine 13 through the bearing housing 5A and the bearing housing 5B in the boss plate portion 5 and through the side surface of the bearing housing 2D of the casing 2, a lubricant feeding passage 17 and a grease nipple 16 communicating to the outer portion are provided in each of the bearing housings 5A, 5B, and 2D to face different directions. In this embodiment, the grease nipple 16 is structured to face the right and left directions when a scroll compressor is viewed from the stationary scroll.

The grease nipple 16 is an injection hole which includes a connection portion to connect a lubricant feeding tool such as a grease gun. The grease nipple 16 is structured to pass the lubricant from the outer portion toward the inside of the bearing housing 5A and the bearing housing 5B. The grease nipple has a function of inhibiting a reverse flowing of the lubricant from the inside of the bearing housing 5A and the bearing housing 5B to the outside. In addition, the grease nipple 16 may be structured to be variable in direction as needed. With such a configuration, the direction of the tip end of the grease nipple can be freely changed regardless of the direction of the lubricant feeding passage 17, and workability is improved. In addition, the grease nipple 16 is provided detachably, and can be replaced as needed.

Figure 5:
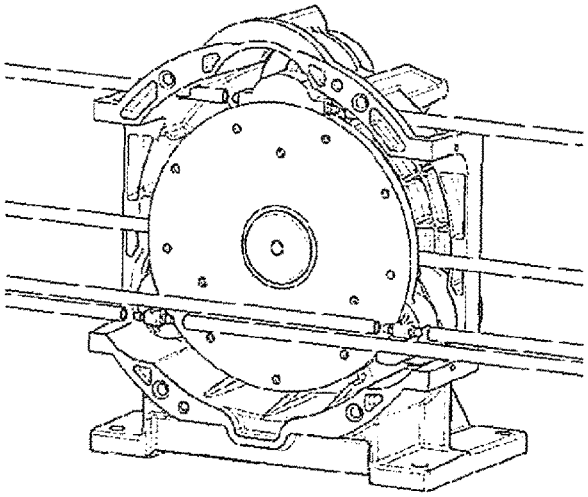
FIG. 5 shows a perspective view of a compressor body according to the first embodiment of the invention.

The lubricant can be replenished from different directions to the orbiting bearing 12 and the auxiliary crank bearing 13C by providing two grease nipples 16. With this configuration, the workability during maintenance can be improved. FIG. 5 illustrates a perspective view during maintenance. For example, in a case where there is an obstacle on the left side of the scroll compressor, the grease may be replenished only from the right side. In a case where there is an obstacle on the right side, the grease may be simply replenished only from the left side without any remaking. In addition, a third grease nipple (not illustrated) may be provided in an upper direction as well as the right and left direction. In this case, even in a case where there are obstacles on the right and left sides, and thus the grease is hard to be replenished, the replenishment can be made from the upper direction, so that it is improved in convenience. Therefore, the number of grease nipples 16 is not limited to "2", but may be "3" or more. In addition, usually, not the grease nipple 16, but a lock screw with a hexagon hole or a rubber plug may be mounted to the lubricant feeding passage 17. In that case, the grease may be replenished after removing the lock screw or the plug.

An opening is provided in the stationary scroll 3 or the casing 2, or between the stationary scroll 3 and the casing 2. Then, the tip end of the grease nipple 16 faces a direction to the opening which is provided in the stationary scroll 3 or the casing 2, or between the stationary scroll 3 and the casing 2. With such a configuration, the lubricant can be replenished through the grease nipple 16 by inserting a tool such as a nozzle from the opening without removing the stationary scroll 3. With this configuration, the workability during maintenance can be improved. In addition, in a case where a plurality of openings are provided in the stationary scroll 3 or the casing 2, or between the stationary scroll 3 and the casing 2, a plurality of grease nipples 16 may be provided to face different openings. With this configuration, even in a case where there is an obstacle in a direction facing one opening, the lubricant can be supplied from the other opening in a direction where no obstacle exists.

A straight line connecting the opening provided in the stationary scroll 3 or the casing 2, or between the stationary scroll 3 and the casing 2 with the tip end of the grease nipple 16 provided in the housing 5A for the orbiting bearing 12 passes between two rotation preventing machines 13. With the grease nipple 16 disposed in such a direction, the lubricant can be supplied from the opening to the grease nipple 16 without blocking the rotation preventing machine 13 when viewed from the opening.

As described above, according to this embodiment, as a pipe to supply the lubricant to the orbiting bearing 12 and the rotation preventing machine 13, the plurality of the lubricant feeding passages 17 and the grease nipples 16 are provided in the boss plate portion 5, and the tip ends of the grease nipples 16 are set to face different directions. Therefore, the lubricant can be easily replenished from a plurality of directions during maintenance. Therefore, the grease can be simply replenished from a direction where no obstacle exists without need of separate design and regardless of installation environments of the scroll compressor. In other words, according to this embodiment, it is possible to improve reliability and workability.

In addition, in this embodiment, the description has been given about an example in which the plurality of lubricant feeding passages 17 and grease nipples 16 are provided as a pipe to supply the lubricant to the orbiting bearing 12 and the rotation preventing machine 13. However, the invention is not limited to the above configuration, and a plurality of injection holes to supply the lubricant to the load side bearing 20 or the anti-load side bearing 21 supporting the drive shaft 9 may be provided with respect to one bearing housing.

Second Embodiment

A scroll compressor according to a second embodiment of the invention will be described using FIG. 6. The same configurations as those of the first embodiment will be assigned with the same symbols, and the descriptions thereof will be omitted. This embodiment has a feature in that there are provided a plurality of grease nipples 16 facing the same direction to supply the lubricant.

Figure 6:
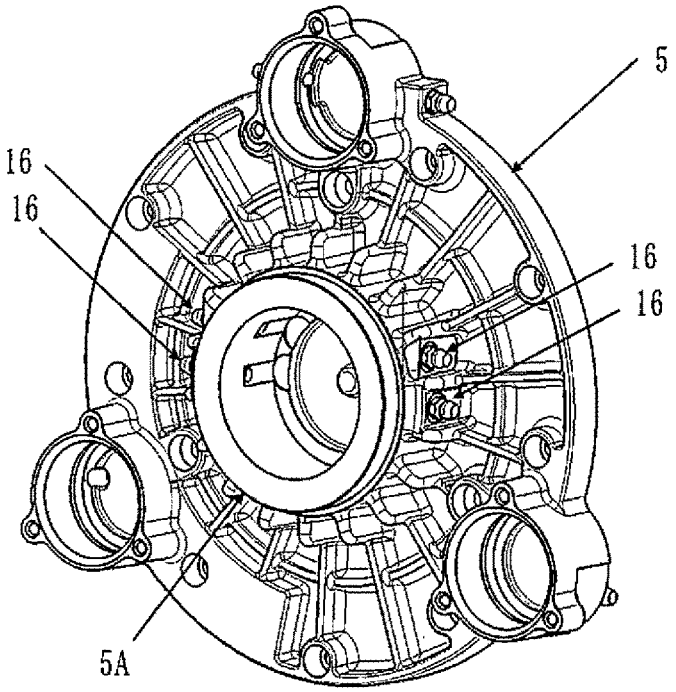
FIG. 6 shows a perspective view of the boss plate portion according to a second embodiment of the invention.

FIG. 6 illustrates the boss plate portion 5 in this embodiment. In this embodiment, two grease nipples 16 facing the same direction are disposed in the bearing housing 5A for the orbiting bearing 12. In a case where an lubricant is replenished by the grease nipple 16, grease is attached to the tip end of the grease nipple 16, and impurities such as dust may be easily attached to the grease nipple 16. In this case, when the lubricant is replenished in the second time, the impurities at the tip end of the grease nipple 16 are mixed with the lubricant and enter the bearing housing 5A, and cause a damage on the orbiting bearing 12. To solve this problem, this embodiment is configured by two grease nipples facing the same direction. Therefore, the grease nipples 16 to be used in the first and second replenishments of the lubricant can be divided, so that it is possible to improve reliability of the orbiting bearing 12 while preventing the impurities from being mixed.

In addition, the grease nipple 16 in the first embodiment has been described to have the function of inhibiting a reverse flowing of the lubricant. In this embodiment, the injection holes having no the function of inhibiting a reverse flowing of the lubricant may be used instead of the plurality of grease nipples 16. One of the injection holes facing the same direction may be used to supply the lubricant, and the other may be used to discharge the lubricant. With this configuration, it is possible to remove the mixed impurities while supplying the lubricant.

In addition, the plurality of grease nipples 16 may be further disposed to face different directions similarly to the first embodiment, so that the lubricant can be replenished regardless of installation environments. Further, it is possible to improve workability and reliability while preventing the impurities from being mixed even in the second time of replenishment. In addition, this embodiment has been described using the structure in which the grease nipples 16 are mounted to face the same direction as that of the bearing housing 5A as an example. The plurality of grease nipples may be provided to face the same direction similarly even in the bearing housings 5B and 2D for the rotation preventing machine 13. In that case, it is possible to improve workability and reliability of the auxiliary crank bearings 13C and 13B.

Further, in a case where the opening is provided in the stationary scroll 3 or the casing 2, or between the stationary scroll 3 and the casing 2, the effects of this embodiment may be achieved if the grease nipples face the same opening even though the grease nipples do not face the same direction.

In this embodiment, the description has been given about an example in which two grease nipples facing the same direction are provided. However, the number of grease nipples is not limited to "2", but may be "3" or more.

Third Embodiment

Figure 7:
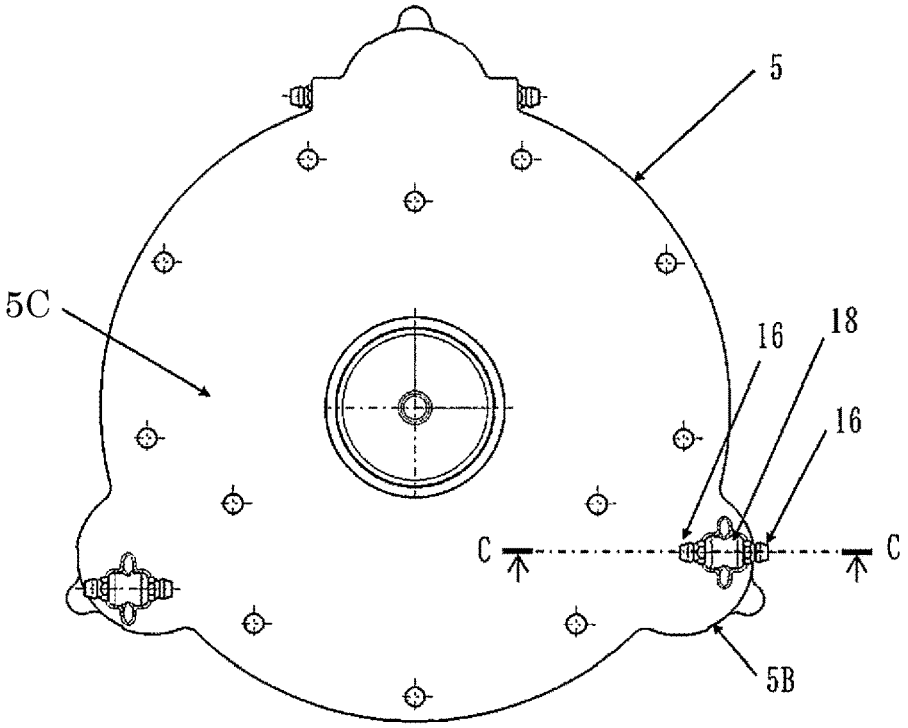
FIG. 7 shows a rear view of the boss plate portion according to the second embodiment of the invention.
Figure 8:
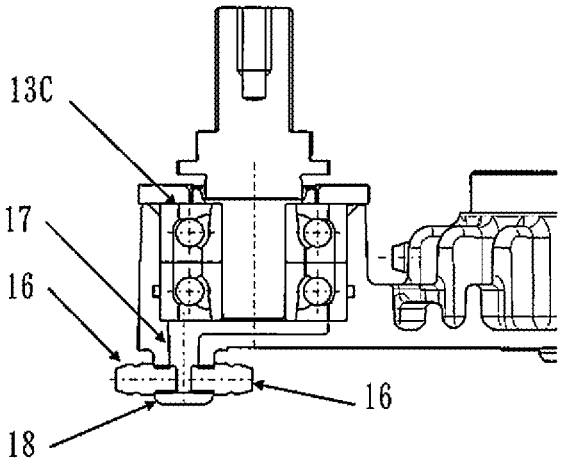
FIG. 8 shows a cross-sectional view of the boss plate portion according to a third embodiment of the invention.
Figure 9:
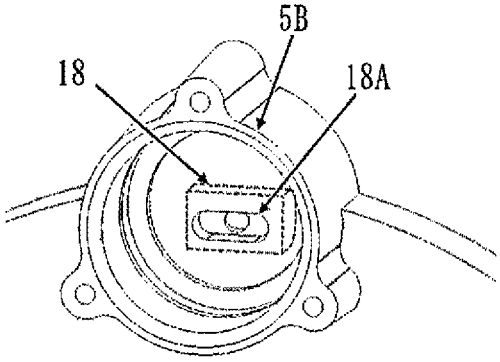
FIG. 9 shows a perspective view of the boss plate portion according to the third embodiment of the invention.

A scroll compressor according to a third embodiment of the invention will be described using FIGS. 7 to 9. The same configurations as those of the first embodiment will be assigned with the same symbols, and the descriptions thereof will be omitted. This embodiment has a feature in that a projection 18 is provided in the bearing housing 5B. FIG. 7 illustrates a rear view of the boss plate portion 5 in this embodiment. In this embodiment, the projection 18 protruding toward the end plate 4A of the orbiting scroll 4 is provided in an end plate surface 5C on a side near the end plate 4A of the orbiting scroll 4 of the boss plate portion 5. The plurality of grease nipples 16 are disposed in the projection 18. FIG. 8 illustrates a cross-sectional view taken along line C-C of the bearing housing 5B of the auxiliary crank in this embodiment. With the projection 18 protruding toward the end plate 4A of the orbiting scroll 4, the lubricant can be replenished even from the opposite side to the rotation axis of the drive shaft 9 of the scroll compressor. For example, the lubricant can be easily replenished to the bearing housing 5B on the right side in FIG. 7 even from the left side in the drawing. In addition, with the projection 18, a flowing direction of the lubricant becomes the same direction as that of a gap of the auxiliary crank bearing 13C. Further, the lubricant can sufficiently flow in the bearing. Therefore, the reliability is improved. In addition, FIG. 9 illustrates a perspective view of the bearing housing 5B. With the configuration of the projection 18, a grease reservoir 18A can be formed to store the lubricant in the projection 18. By forming the grease reservoir 18A, the amount of lubricant to be stored in the bearing housing is increased, and a period up to next maintenance can extend. In this embodiment, the description has been given about a case where the projection 18 is provided at a position corresponding to the bearing housing 5B of the auxiliary crank bearing 13B of the end plate surface 5C of the boss plate portion 5. However, the same effect may be achieved even in a case where the projection protruding toward the end plate 4A of the orbiting scroll 4 is provided at a position corresponding to the bearing housing 5A of the orbiting bearing 12 of the end plate surface 5C of the boss plate portion 5.

Fourth Embodiment

Figure 10:
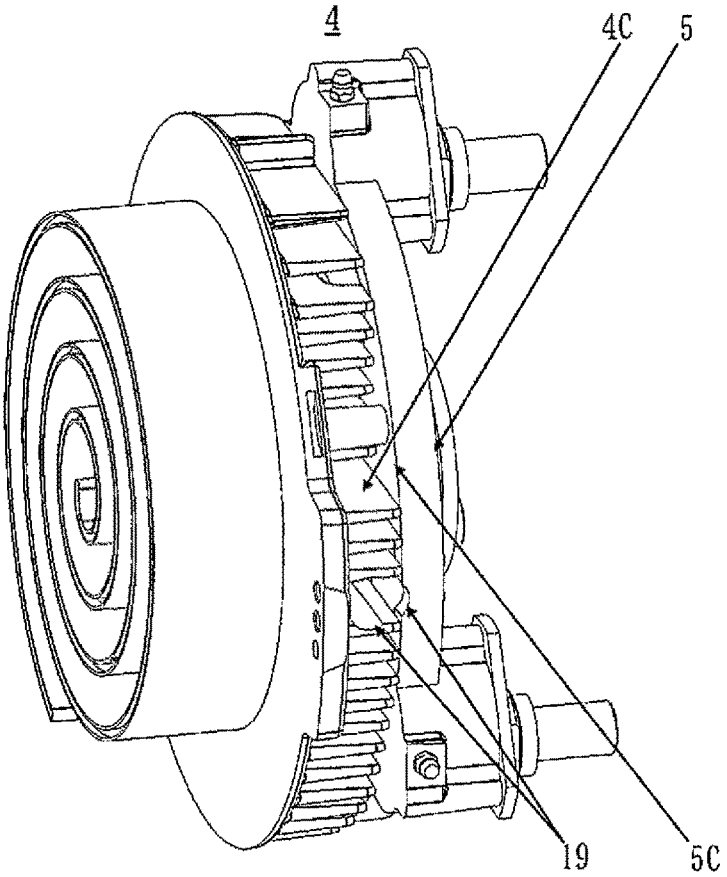
FIG. 10 shows a perspective view of the boss plate portion according to a fourth embodiment of the invention.
Figure 11:
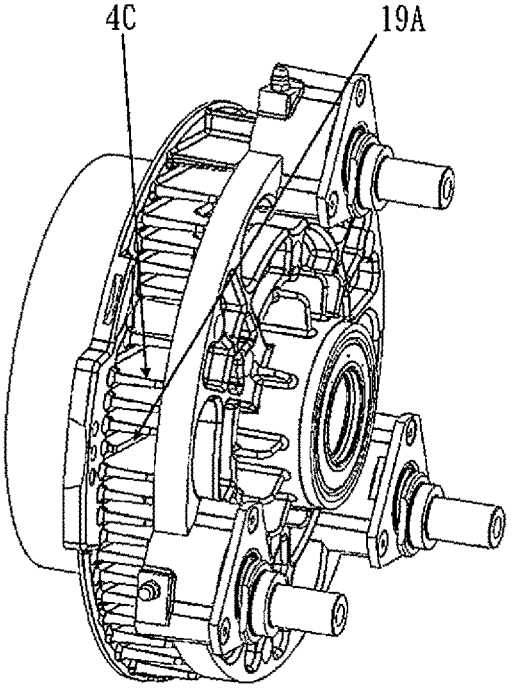
FIG. 11 shows a perspective view of the boss plate portion according to the fourth embodiment of the invention.
Figure 12:
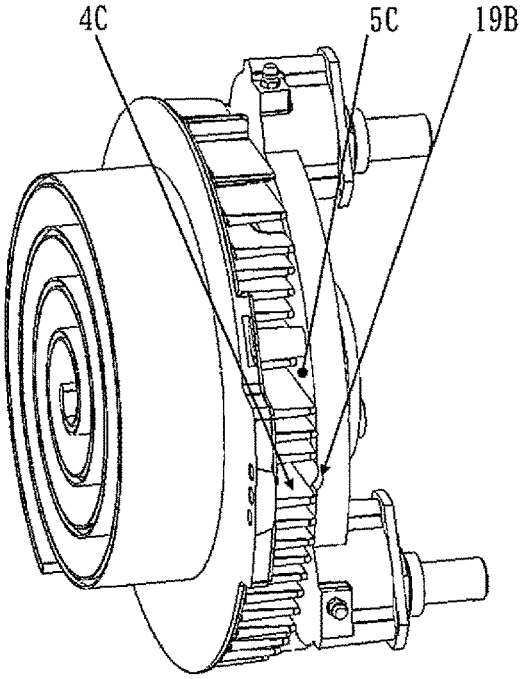
FIG. 12 shows a perspective view of the boss plate portion according to the fourth embodiment of the invention.
Figure 13:
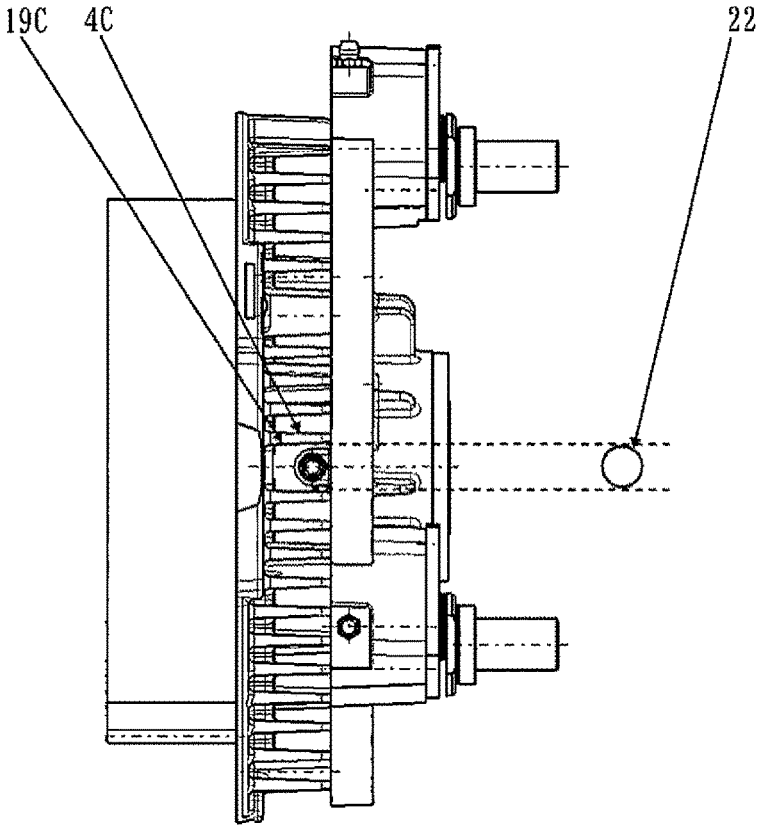
FIG. 13 shows a side view of the boss plate portion according to the fourth embodiment of the invention.
Figure 14:
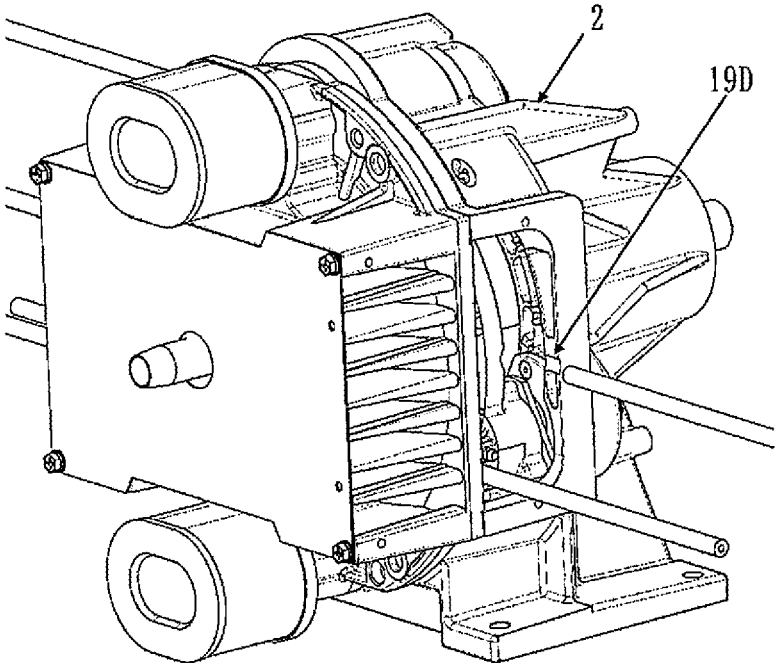
FIG. 14 shows a perspective view of the compressor body according to the fourth embodiment of the invention.

A scroll compressor according to a fourth embodiment of the invention will be described using FIGS. 10 to 14. The same configurations as those of the first embodiment will be assigned with the same symbols, and the descriptions thereof will be omitted. This embodiment has a feature in that there is provided with a guide for supplying the lubricant. FIG. 10 illustrates a perspective view of the orbiting scroll 4 and the boss plate portion 5. In this embodiment, the projection 18 is provided in the rear surface (on a side near the orbiting scroll 4) of the bearing housing 5A. Two grease nipples 16 are disposed in the projection 18. In addition, a guide 19 along a nozzle for supplying the grease is formed in the cooling fin 4C which is in the rear surface of the end plate 4A of the orbiting scroll 4. With this configuration, the lubricant can be easily replenished even in a case where the grease nipple 16 disposed in the rear surface of the bearing housing 5A of the boss plate portion 5 is not possible to be viewed. Further, it is possible to improve workability during maintenance.

FIGS. 11 to 14 illustrate modifications of this embodiment. In the modification illustrated in FIG. 11, a guide 19A is formed by making a part of the cooling fin 4C low. In addition, in the modification illustrated in FIG. 12, a guide 19B is similarly formed by making a part of the end plate surface 5C of the boss plate portion 5 dented. With such a configuration, the guide can be easily formed. In addition, in the modification illustrated in FIG. 13, a guide 19C is formed by making an interval of the cooling fins 4C matched with the diameter of a nozzle of the grease gun 22. In addition, in the modification illustrated in FIG. 14, a guide 19D is formed similarly by making a part of the casing 2 dented.

Hitherto, according to this embodiment, the workability during maintenance can be further improved compared to the first embodiment since the guide 19 is formed along the nozzle for supplying the grease.

In addition, according to this embodiment, the reliability and the maintenance performance can be further improved compared to the first and second embodiments since the projection 18 is provided in the boss plate portion 5.

Fifth Embodiment

A scroll compressor according to a fifth embodiment of the invention will be described using FIG. 15. The same configurations as those of the first embodiment will be assigned with the same symbols, and the descriptions thereof will be omitted.

Figure 15:
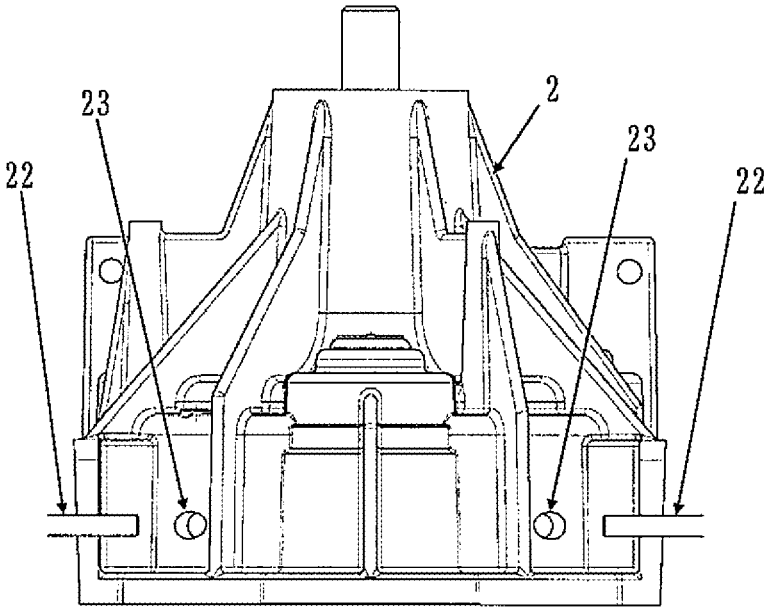
FIG. 15 shows a top view of a casing according to a fifth embodiment of the invention.

FIG. 15 illustrates a top view of the casing 2 according to this embodiment. This embodiment has a feature in that a plurality of replenishment passages are provided as openings in the side surface of the casing 2 to replenish the lubricant to the bearing housing 5B (not illustrated). A plurality of replenishment passages 23 serving as channels of the nozzles of the grease gun 22 are disposed in the side surface of the casing 2 with different nozzle-inserting directions in accordance with positions of the grease nipples 16 disposed in the bearing housing 5B (not illustrated). With this configuration, the lubricant can be easily replenished to the grease nipple 16 disposed in the bearing housing 5B. In addition, outside the maintenance hours, the replenishment passage 23 may be mounted with a rubber lid which is easily removed. With the rubber lid, it is possible to prevent that a cool air is leaked out of the replenishment passage 23 during the operation of the compressor. Further, since the rubber lid is easily removed, the workability during maintenance is not degraded.

In this embodiment, the replenishment passage 23 is provided in the side surface of the casing 2. However, the installation is not limited to the casing 2, and the replenishment passage may be provided in the stationary scroll 3. In addition, the replenishment passage may be provided between the casing 2 and the stationary scroll 3.

The embodiments described above have been described as merely exemplary to implement the invention. A technical scope of the invention should not be interpreted in a limited way by these embodiments. In other words, the invention may be implemented in various ways without departing from technical ideas or principal features. In addition, the invention may be implemented by combining a plurality of embodiments.

Further, the description has been given about the scroll fluid machine, but the invention is not limited to the scroll fluid machine. The invention may be applied to other fluid machines such as a reciprocating compressor and a screw compressor as long as a fluid machine body is driven by compressing or expanding a fluid by the drive shaft, and a bearing supporting the drive shaft or a bearing supporting a driven shaft driven along with the rotation of the drive shaft is provided.

REFERENCE SIGNS LIST

1 compressor body
2 casing
2A cylindrical portion
2B bottom
2C bearing mounting portion
2D bearing housing
3 stationary scroll (scroll member)
3A end plate
3B wrap
3C support portion
4 orbiting scroll (scroll member)
4A end plate
4B wrap
4C cooling fin
5 boss plate portion
5A bearing housing (orbiting bearing)
5B bearing housing (auxiliary crank bearing)
5C end plate surface
6 compressor
7 intake port
7A air filter
8 discharge port
9 drive shaft
10 crank
11 balance weight
12 orbiting bearing
13 rotation preventing machine
13A auxiliary crank shaft
13B auxiliary crank bearing
13C auxiliary crank bearing
13D pressing plate
13E flathead bolt
13F seal member (auxiliary crank bearing)
13G outer wheel
14 discharge pipe (discharge fluid path)
15 seal member (orbiting bearing)
16 grease nipple
17 lubricant feeding passage
18 projection
18A grease reservoir
19 guide
19A cooling fin guide
19B boss plate guide
19C cooling fin gap guide
19D casing guide
20 load side bearing
21 anti-load side bearing
22 nozzle of grease gun
23 replenishment passage

The invention claimed is:

1. A scroll fluid machine, comprising:
a stationary scroll which is provided with a wrap in an end plate;
an orbiting scroll which is provided with a wrap facing the wrap of the stationary scroll in an end plate;
a drive shaft which drives the orbiting scroll;
an orbiting bearing which supports the drive shaft with respect to the orbiting scroll; and
a plurality of injection holes through which a lubricant is injected to the orbiting bearing from an outer portion;
wherein the orbiting scroll includes a boss plate portion which is connected to the drive shaft;
wherein a projection formed in an end plate surface of the boss plate portion protrudes from the boss plate portion toward the end plate of the orbiting scroll; and
wherein the plurality of injection holes through which the lubricant is injected to the orbiting bearing from the outer portion is provided in the projection.

2. The scroll fluid machine according to claim 1,
wherein a plurality of the injection holes are provided in a bearing housing which stores the orbiting bearing.

3. The scroll fluid machine according to claim 1,
wherein tip ends of the plurality of injection holes are formed to face different directions.

4. The scroll fluid machine according to claim 1,
wherein each of the injection holes is configured to connect to a lubricant feeding tool.

5. The scroll fluid machine according to claim 4,
wherein a tip end of the each of the injection holes is variable in direction.

6. The scroll fluid machine according to claim 4, comprising:
a casing which is mounted in the stationary scroll and provided on an outside in a radial direction of the orbiting scroll,
wherein a plurality of openings are provided in the stationary scroll or the casing, and
wherein tip ends of at least two injection holes face directions of different openings.

7. The scroll fluid machine according to claim 6, comprising:
a rotation preventing machine which prevents the orbiting scroll from rotating,
wherein a straight line connecting the opening with the injection hole passes between a plurality of the rotation preventing machines.

8. The scroll fluid machine according to claim 4, comprising:
a casing which is mounted in the stationary scroll and provided on an outside in a radial direction of the orbiting scroll,
wherein a plurality of openings are provided in the stationary scroll or the casing, and
wherein tip ends of at least two injection holes face directions of a same opening.

9. The scroll fluid machine according to claim 4,
wherein the lubricant passes through each of the injection holes from an outer portion of a bearing housing which stores the orbiting bearing toward an inner portion, and does not pass through from the inner portion to the outer portion.

10. The scroll fluid machine according to claim 1,
wherein a guide for supplying grease is formed in a cooling fin provided in the orbiting scroll, the boss plate portion, or the casing.

11. The scroll fluid machine according to claim 1,
wherein a grease reservoir is disposed inside of the projection.

12. A scroll fluid machine, comprising:
a stationary scroll;
an orbiting scroll which is provided to face the stationary scroll;
a casing which stores the orbiting scroll;
a drive shaft which drives the orbiting scroll; and
a plurality of rotation preventing machines which prevent the orbiting scroll from rotating,
wherein a bearing housing to store the plurality of rotation preventing machines is provided on a side near each of the casing and the orbiting scroll,
wherein at least one of the plurality of rotation preventing machines is provided with a plurality of injection holes which inject a lubricant from each outer portion to the bearing housing on a side of each of the casing and the orbiting scroll,
wherein the orbiting scroll includes a boss plate portion which is connected to the drive shaft,
wherein a projection formed in an end plate surface of the boss plate portion protrudes from the boss plate portion toward the end plate of the orbiting scroll, and
wherein the plurality of injection holes to inject the lubricant into the bearing housing on a side near the orbiting scroll is provided in the projection.

13. The scroll fluid machine according to claim 12,
wherein tip ends of the plurality of injection holes face different directions.

14. The scroll fluid machine according to claim 12,
wherein each of the injection holes is configured to connect to a lubricant feeding tool.

15. The scroll fluid machine according to claim 14,
wherein a tip end of each of the injection holes is variable in direction.

16. The scroll fluid machine according to claim 14,
wherein a plurality of openings are provided in the stationary scroll or the casing, and
wherein tip ends of at least two injection holes face directions of different openings.

17. The scroll fluid machine according to claim 14, comprising:
a casing which is mounted in the stationary scroll and provided on an outside in a radial direction of the orbiting scroll,
wherein a plurality of openings are provided in the stationary scroll or the casing, and
wherein tip ends of at least two injection holes face directions of a same opening.

18. The scroll fluid machine according to claim 14,
wherein the lubricant passes through each of the injection holes from an outer portion of the bearing housing toward an inner portion, and does not pass through from the inner portion to the outer portion.

19. The scroll fluid machine according to claim 12,
wherein a guide for supplying grease is formed in a cooling fin provided in the orbiting scroll, the boss plate portion, or the casing.

* * * * *